United States Patent [19]

Horsewell et al.

[11] Patent Number: 4,649,942

[45] Date of Patent: Mar. 17, 1987

[54] SMOKING ARTICLES

[75] Inventors: Henry G. Horsewell, Totton; Martin G. Duke, Southampton, both of United Kingdom

[73] Assignee: British-American Tobacco Company, Ltd., London, England

[21] Appl. No.: 780,735

[22] Filed: Sep. 26, 1985

[30] Foreign Application Priority Data

Oct. 3, 1984 [GB] United Kingdom ..... 8424978

[51] Int. Cl.[4] ..... A24D 3/02

[52] U.S. Cl. ..... 131/336; 131/339

[58] Field of Search ..... 131/336, 339, 340

[56] References Cited

U.S. PATENT DOCUMENTS 4,365,641 12/1982 Johnson ..... 131/336
4,542,754 9/1985 Cantrell et al. ..... 131/336
4,557,281 12/1985 Litzinger ..... 131/336

FOREIGN PATENT DOCUMENTS 0061275 9/1982 European Pat. Off. ..... 131/336
2150414 7/1985 United Kingdom ..... 131/336

*Primary Examiner*—V. Millen
*Attorney, Agent, or Firm*—Charles G. Lamb

[57] ABSTRACT

A smoking article mouthpiece comprises a smoke passage and a ventilation air duct, both of which extend from end-to-end of the mouthpiece. The duct is of a depth of 25% or more of the diameter of the mouthpiece. When the mouthpiece is incorporated in a smoking article such that air may enter the duct, the ratio of the velocities of air and smoke is in excess of ten. The mouthpiece may also comprise a ventilation-air collection groove which extends about the element and opens into the ventilation air duct.

12 Claims, 7 Drawing Figures

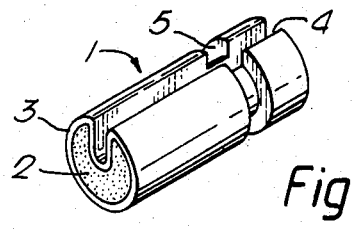
Fig. 1.
Fig. 2.
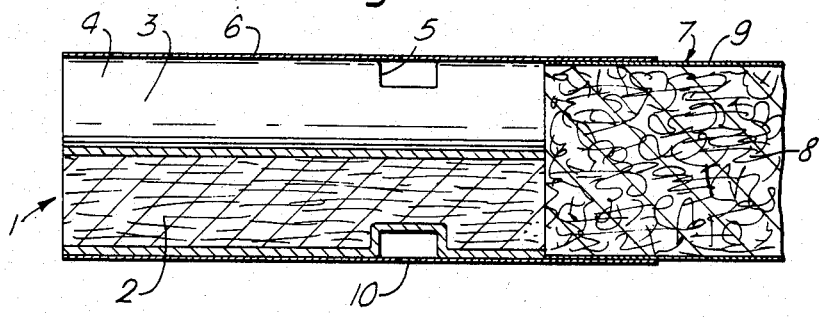
Fig. 3.
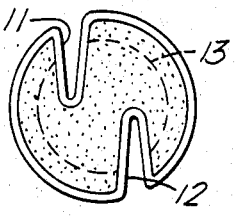
Fig. 4.
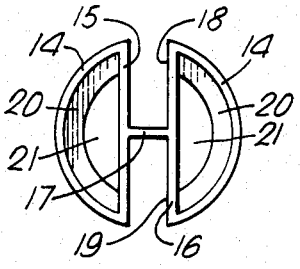
Fig. 5.
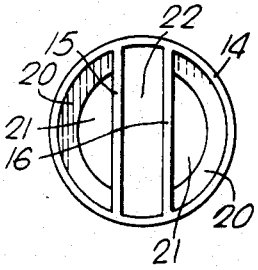

SMOKING ARTICLES

This invention relates to mouthpiece elements for smoking articles and to smoking articles incorporating mouthpiece elements, particularly but not exclusively cigarettes. So-called ventilated cigarette filters are known which are of a type comprising a body of filtration material wrapped in air impervious wrapping means in which wrapping means are formed a plurality of grooves disposed at the periphery of the filter and extending, from a location spaced from the tobacco end of the filter, to the mouth end of the filter. The grooves are shallow, being typically up to 0.75 mm deep. In a cigarette incorporating such a filter a tipping overwrap is provided with ventilation perforations some of which overlie the grooves. When the cigarette is smoked, tobacco smoke is drawn through the filtration material and ventilation air is drawn through the perforations and into the shallow grooves. Not until the air issues from the mouth end of the grooves does it come into contact with the tobacco smoke. Some filters may be termed "segregated peripheral ventilation (SPV) filters". The air issues from each of the grooves of an SPV filter as a jet. These jets cause changes in the pattern of the smoke issuing from the body of filtration material and it has been discovered that changes in this pattern may affect advantageously the smoker's sensory perception of the smoke.

SPV filters are described in United Kingdom Patent Application Publication No. 2 046 573A.

We have determined that two factors are of importance in obtaining desired smoke distribution patterns and, by selection or application of these two factors in combination, various patterns may be obtained.

The first factor is the ratio of air velocity to smoke velocity at exit from the filter. We have found that this ratio should be in excess of ten (10) when the smoking takes place under standard machine-smoking conditions. The second factor relates to the degree of contact between the air and the smoke at exit from the filter; the greater the degree of contact, the greater the change in the smoke pattern.

In the United Kingdom Patent Application Publication No. 2 100 573A, there is described a cigarette mouthpiece device in the use of which segregated ventillation air issues from the centre of the mouth end of the mouthpiece and tobacco smoke issues from the remaining proportion of the mouth end. Since the air jet is surrounded by smoke, the degree of contact between air and smoke is better than is the case with an SPV filter and thus it could be expected that the smoke pattern would be affected to a greater extent. However, the mouthpiece is of complex construction and may be difficult and expensive to manufacture.

It is an object of the present invention to provide an improved device which is simple and comparatively inexpensive to manufacture, whilst maintaining full effectiveness in the production of advantageous smoke patterns.

As used herein, the term "mouthpiece element" refers to an element incorporated, or to be incorporated, in a smoking article at the mouth end thereof, or an element being, or forming part of, a smoking article holder. Such an element, or a portion thereof, may take the form of a filter.

The present invention provides a smoking article mouthpiece element of generally cylindrical form comprising a smoke passage extending from end-to-end of said element and being open at each end of said element and a ventilation air duct of substantially uniform cross-section extending from end-to-end of said element and being open at each end of said element, said duct extending inwardly of the periphery of said element for a depth equivalent to 25% or more of the transverse dimension of the element, whereby when said element is incorporated in a smoking article in such manner as to permit ingress of ventilation air to said duct and the smoking article is smoked under standard machine-smoking conditions, the ratio of the velocity of the ventilation air to the velocity of the smoke at exit from said element is in excess of ten.

The ventilation duct may extend from the periphery of the mouthpiece element in a radial direction of the element. Alternatively, the duct may extend parallel to a diametral plane of the element. Preferably, the ventilation duct extends from the periphery of the element for a depth equivalent to 50% or more of the diameter of the element. Advantageously, the duct extends to a location not more than a distance from the longitudinal axis of the element equivalent to about 25% of the radius of the element. More advantageously, the duct extends to the longitudinal centre line of the mouthpiece element or to the proximity thereof. The ventilation duct suitably opens at the periphery of the element over the full length of the element.

The ventilation duct may be of any desired cross-sectional shape. It may, for example, be of a generally U or V cross-section.

The walls of the ventilation duct are preferably gas impervious.

The mouthpiece element may comprise, at a location distant the mouth end of the element, a ventilation-air collection groove. Such groove suitably extends circumferentially of the element and intersects the ventilation duct. The walls of the groove are preferably gas impervious.

When the mouthpiece element is incorporated in a smoking article in such manner as to permit ingress of air to the ventilation duct, at a draw rate on the article of 17.5 $cm^3$/second, the ratio of the velocity of the ventilation air to the velocity of the smoke at exit from the mouthpiece is in excess of ten. Preferably this ratio should be at least fifteen, and more preferably at least twenty. The cross-sectional area of the ventilation duct is determined in accordance with a required velocity value of the ventilation air. Thus, for example, if a depth value of the duct is predetermined, the width of the duct, assuming the duct to be of generally rectangular cross-section, will be governed by the required velocity value of the air. The ventilation level of the smoking article is preferably in a range of 20% to 90% and more preferably in a range of 50% to 85%.

Although hereinabove there is mention of one ventilation duct, the mouthpiece element may be provided with two such ducts. It is even conceivable that more than two ventilation ducts could be provided, although this is not to be preferred since the structural stability of the element would be likely to be adversely affected. Furthermore, if several deep ducts were to be provided, then in order to conform to air velocity requirements, the cross-sectional areas of the ducts would require to be of such small value that the draw resistance of the ducts would be high, probably unacceptably high.

Mouthpiece elements in accordance with the present invention may comprise plugs of tobacco-smoke filtration material, cellulose acetate or polypropylene for example, into which the ventilation duct(s) has been formed as, for example, by thermal moulding. Such a plug may comprise a wrapper which extends about the peripheral surface of the plug and lines the duct(s). The wrapper may be of a thermally mouldable material such, for example, as that which is disclosed in United Kingdom Patent Application Document No. 2 134 365A. An alternative material for the wrapper would be a gas impervious film-like material, of cellulose acetate for example.

As an alternative to the mouthpiece element comprising a plug of filtration material, it can take the form of a generally tubular, substantially rigid body of plastics or other material.

With the cross-section of the ventilation duct(s) being constant, the element may be readily produced from a continuous extrusion, an annular air collection groove, if required, being formed in each unit length by, for example, a thermal moulding process. Mouthpiece elements according to the present invention may also be formed using an injection moulding process.

In order that the invention may be clearly understood and readily carried into effect, reference will now be made, by way of example, to accompanying diagrammatic drawings, in which:

FIG. 1 shows a perspective view of a mouthpiece element intended for incorporation in a cigarette;

FIG. 2 shows, in axial section and to a somewhat larger scale, parts of a cigarette comprising the mouthpiece shown in FIG. 1;

FIGS. 3 to 5 show mouth end views of respective mouthpiece elements all of which are different from the mouthpiece of FIG. 1.

Figure 6:
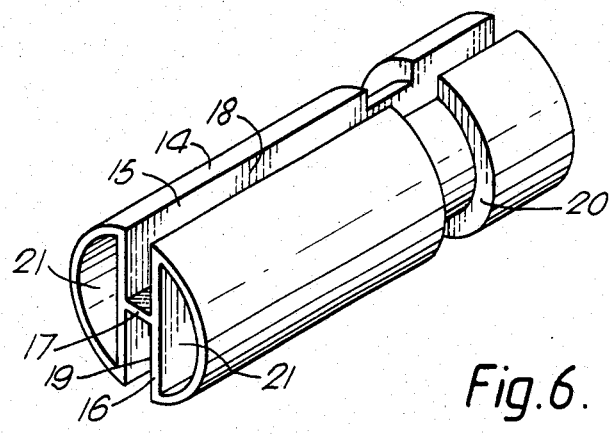
FIGS. 6 and 7 show perspective views of the mouthpiece elements of FIGS. 4 and 5 respectively.

The mouthpiece element which is shown in FIGS. 1 and 2, which element is generally designated by reference numeral 1, is of the form of an 8 mm diameter plug 2 of fibrous cellulose acetate filtration material wrapped in a wrapper 3 of a gas impervious film-like material to form a peripheral wall. A generally U-form groove 4, providing a ventilation duct, extends from end-to-end of element 1. The depth of the groove 4 is 3 mm. The groove 4 is lined by the wrapper 3, thus to provide gas impervious walls to the groove 4.

At a location distant the mouth end of the mouthpiece element 1 a ventilation-air collection groove 5 extends around the element 1 so as to intersect, i.e. open into, the groove 4.

Referring now specifically to FIG. 2, a tipping wrapper 6 serves to interattach the mouthpiece element 1 and a tobacco rod, only a part of which rod, designated 7, being shown. The rod 7 comprises a filler 8, of tobacco or other smoking material, wrapped in a cigarette paper wrapper 9. The tipping wrapper 6 is provided with a ring or zone of ventilation perforations 10, which ring or zone encircles the element 1 and overlies the groove 5. Other than as provided by the perforations 10, the wrapper 6 may be air impervious.

When the cigarette of FIG. 2 is smoked, air is drawn through the perforations 10 into the groove 5 and therefrom into the groove 4. At the same time, tobacco smoke is drawn through the filtration material of which the plug 2 is comprised. The smoke issues from the mouth end of the plug 2 in intimate contact with a jet of air, with a small proportion of unfiltered smoke, issuing from the groove 4. The cross-sectional area of the groove 4 is so selected as to ensure that the velocity of the air is in excess, by a factor of at least more than ten, of the velocity of the tobacco smoke from plug 2. Because of the intimate contact of air and smoke and because of the high air/smoke velocity ratio, a marked change in the smoke pattern is obtained as compared with SPV filters.

If, for example, the cross-sectional area of the groove 4 is 8 $mm^2$, the cross-sectional area of the tobacco smoke passage in the plug 2 is 42 $mm^2$ and the relative pressure drops of the ventilation air and smoke paths are such that the ventilation level is 80%, then the air/smoke velocity ratio will be about 20.

The mouthpiece element, a mouth end view of which is shown in FIG. 3, is generally similar in form and materials to that shown in FIGS. 1 and 2, but it comprises two ventilation ducts in the form of grooves 11 and 12. It also comprises an annular ventilation-air collection groove, as is indicated by broken line 13. The mouthpiece element of FIG. 3 could be used in place of element 1 in the cigarette of FIG. 2.

Although each of the mouthpiece elements mouth end views of which are shown in FIGS. 4 and 5 could be used in place of element 1 in the cigarette of FIG. 2, they are of different construction from element 1 in that each is produced from a plastics material by, for example, an injection moulding process.

The mouthpiece element of FIG. 4 is of generally tubular form and comprises a peripheral wall 14 and two partition walls 15 and 16, which latter walls are interconnected by a web 17. There are thus defined two groove-form ventilation ducts 18 and 19. As is indicated by reference numeral 20, there is also provided an annular ventilation-air collection groove which opens into the groove-form ducts 18, 19. The opening of groove 20 into duct 18 can be seen clearly in FIG. 6. Spaces 21 bounded by the wall 14 and the partition walls 15, 16 provide smoke passages. These spaces 21 may contain smoke filtration material.

Figure 7:
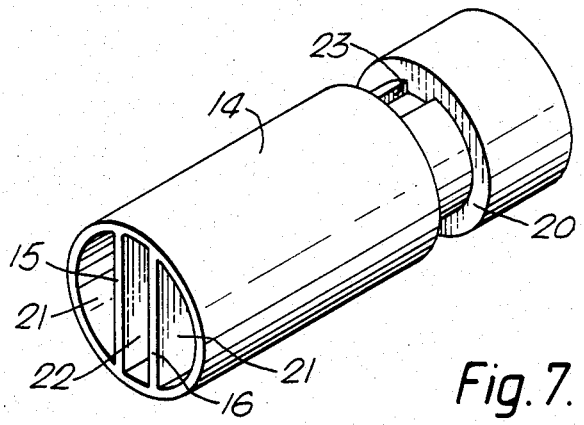

The mouthpiece element of FIG. 5 is similar to that of FIG. 4 and thus the same reference numerals have been used for similar parts. In the element of FIG. 5 there is no web interconnecting the partition walls 15, 16. Instead, the walls 15, 16 are interconnected, at the upper and lower extremities thereof, by integral portions of the peripheral wall 14. Thus, a single ventilation-air duct 22 is provided, which duct 22 is open at the periphery of the element by way of diametrically opposed holes in the base of the groove 20. One such hole, designated 23, is shown in FIG. 7. Filtration material may also be disposed within the spaces 21.

When a mouthpiece element of either FIGS. 4 and 6 or 5 and 7 is incorporated in a cigarette, a plug of filtration material may be disposed intermediate the element and the smoking material rod.

Although the above described mouthpiece elements are of circular cross-section, it will be appreciated that mouthpiece elements in accordance with the present invention could comprise a non-circular cross-section, an elliptical or lenticular cross-section for example.

What is claimed is:

1. A smoking article mouthpiece element of generally cylindrical form comprising a peripheral wall defining a smoke passage extending from end-to-end of said element and being open at each end of said element and a ventilation air duct of substantially uniform cross-section extending from end-to-end of said element and being open at each end of said element, said duct extending inwardly of the periphery of said element for a depth equivalent to 25% or more of the transverse dimension of the element, whereby when said element is incorporated in a smoking article in such manner as to permit ingress of ventilation air to said duct and the smoking article is smoked, the ratio of the velocity of the ventilation air to the velocity of the smoke at exit from element is in excess of ten.

2. A mouthpiece element as claimed in claim 1, wherein said ratio is at least fifteen.

3. A mouthpiece element as claimed in claim 2, wherein said ratio is at least twenty.

4. A mouthpiece element as claimed in claim 1, wherein the walls of said duct are substantially gas impervious.

5. A mouthpiece element as claimed in claim 1, wherein said duct extends inwardly of the periphery of said element for a depth equivalent to 50% or more of the transverse dimension of said element.

6. A mouthpiece element as claimed in claim 1, wherein said duct is one of a plurality of commonly configured ventilation ducts.

7. A mouthpiece element as claimed in claim 1, wherein the or each of the ventilation ducts opens at the periphery of said element over the full length of said element.

8. A mouthpiece element as claimed in claim 1, wherein said element comprises a ventilation-air collection groove which opens at the periphery of said element and intersects the ventilation duct or one or all of the ventilation ducts.

9. A mouthpiece element as claimed in claim 1, wherein tobacco-smoke filtration material is disposed in said smoke passage.

10. A mouthpiece element as claimed in claim 9, wherein a wrapper of gas impervious film-like material extends about the periphery of said element and lines said duct.

11. A mouthpiece element as claimed in claim 1, wherein said element takes the form of a generally tubular, substantially rigid body of plastics material.

12. A smoking article comprising a mouthpiece element according to claim 1, a rod of smoking material and a wrapper interattaching said element and said rod and providing for the ingress of ventilation air to said duct, the ventilation level of said smoking article being in a range of 50% to 85%.

* * * * *